US005629689A

United States Patent [19]

Curwood

[11] Patent Number: 5,629,689

[45] Date of Patent: May 13, 1997

[54] WARNING SYSTEM

[75] Inventor: Robert J. Curwood, South Melbourne, Australia

[73] Assignee: Wholesale Publications Pty. Ltd., South Melbourne, Australia

[21] Appl. No.: 404,145

[22] Filed: Mar. 14, 1995

[30] Foreign Application Priority Data

Mar. 15, 1994 [AU] Australia ..... PM4475

[51] Int. Cl.[6] ..... G08G 1/00

[52] U.S. Cl. ..... 340/902; 340/903; 340/904; 340/825.54; 455/51.1

[58] Field of Search ..... 340/902, 901, 340/903, 904, 905, 906, 961, 435, 436, 825.72, 825.69, 825.54; 450/51.1, 34.2; 370/85.2

[56] References Cited

U.S. PATENT DOCUMENTS

| | | | |
|---|---|---|---|
| 3,235,025 | 2/1966 | Quinn | 340/903 |
| 3,293,600 | 12/1966 | Gifft | 340/903 |
| 4,352,183 | 9/1982 | Davis et al. | 455/34.2 |
| 4,376,310 | 3/1983 | Stackhouse et al. | 455/34.2 |
| 5,068,654 | 11/1991 | Husher | 455/51.1 |
| 5,235,329 | 8/1993 | Jackson | 340/902 |
| 5,307,060 | 4/1994 | Prevulsky et al. | 340/902 |

FOREIGN PATENT DOCUMENTS

76391/87 1/1988 Australia .

*Primary Examiner*—Jeffery Hofsass
*Assistant Examiner*—Nina Tong
*Attorney, Agent, or Firm*—Michael D. Bednarek; Kilpatrick & Cody

[57] ABSTRACT

A warning system comprises a receiver adapted to receive and recognize a coded signal, and upon reception and recognition thereof to generate a warning signal; and a transmitter selectively actuable to transmit a coded signal receivable and recognizable by the receiver and including a monitor for monitoring the presence of an extraneous signal originating from another transmitter, the transmitter delaying transmission of the coded signal upon detection of the extraneous signal.

7 Claims, 8 Drawing Sheets

WARNING SYSTEM

FIELD OF THE INVENTION

This invention relates to a warning system.

The invention has particular but not exclusive application to warning systems for vehicles, but could for example be used in communication, monitoring and paging systems where a range of signal sources have competing priorities.

When used for vehicles, the system is applicable to all types of vehicles including rail-mounted vehicles such as trains and floating vehicles such as ships. However, the invention will be hereinafter described in a non-limiting manner with reference to road vehicles.

The system is herein described with reference to the specific application of warning the operator of a vehicle of the proximity of emergency vehicles. However the system may also be used to warn the operator of the proximity of the vehicle to other potential hazards such as road works, ice patches, flooded areas, rail crossings, maintenance vehicles, road signs, temporary road furniture, etc. The system also has utility in supplementing the sensory input to vehicle operators with disabilities, eg deafness.

BACKGROUND OF THE INVENTION

Emergency vehicles such as police, ambulance and fire engines are usually fitted with warning means in the form of lights and sirens for alerting other road users to their proximity, both for the safety of the other road users and also so that the emergency vehicle may be given right of way.

A problem with lights and sirens is that they are often ineffective in alerting other road users of the proximity of emergency vehicles for a number of reasons. For example, sirens may not be heard due to high ambient noise levels. Furthermore, modern cars are often equipped with stereo systems and air-conditioning in which case the driver may be insulated, and hence oblivious, to external events. Similarly, lights can be ineffective in daylight, smoke, heavy rain or fog, and furthermore lights are reliant on line of sight and attentiveness on the part of the driver, particularly in the monitoring of driving mirrors.

It has been previously proposed that a transmitter/receiver arrangement be utilised to overcome the above noted ineffectiveness of conventional warning means, ie lights and sirens. Specifically, the emergency vehicle can carry a transmitter which will send a signal which is received by a receiver disposed in the vehicle of a normal road user, the receiver being adapted to generate a signal readily perceivable to the operator of the vehicle.

However for both practical and regulatory reasons it is necessary that transmitters associated with different emergency vehicles transmit at the same frequency. Moreover, for reasons of system integrity and to avoid false alarms, it is necessary that the signal transmitted by the transmitter be coded in some way to ensure that the receiver only warns a driver in response to transmissions originating from emergency vehicles.

Accordingly, a situation is likely to arise, for example when fire, police and fire engines all attend a road accident, where a plurality of transmitters are likely to be operative in a common area. Similarly, there may exist situations where signals, not being signals from other emergency vehicles, are present on the relevant radio frequency. This creates a potential problem wherein the coded signal is superimposed and hence corrupted to a point where the receiver does not recognize the coded signal and accordingly no warning is given to the operator of the vehicle.

It has been proposed that the risk of superimposition of coded signals originating from different emergency vehicles be minimized by transmitting the coded signals in pulses, i.e., the coded signal is transmitted periodically with the majority of the period being "silent". This allows a psuedo-interleaving or random time division to take place and reduces, but does not eliminate, the likelihood of superimposition and hence corruption of coded signals.

Such a system is disclosed in the present applicant's Australian Patent Application 76391/87 which is incorporated herein by cross-reference.

Whilst the proposal of 76391/87 offers a partial solution, there remains a real likelihood of superimposition and corruption of the coded signal due to the presence of other non-emergency-vehicle-originating signals or other coded signals from emergency vehicles.

SUMMARY OF THE INVENTION

The invention aims to reduce the likelihood of coded signal corruption.

This invention in one aspect resides broadly in a warning system comprising:

- a receiver adapted to receive and recognize a coded signal, and upon reception and recognition thereof to generate a warning signal; and
- a transmitter selectively actuable to transmit a coded signal receivable and recognizable by the receiver and including monitoring means for monitoring the presence of an extraneous signal originating from another transmitter, the transmitter delaying transmission of the coded signal upon detection of the extraneous signal.

The transmission of the coded signal may be delayed by a predetermined time interval or may be delayed until the monitoring means determines that the extraneous signal has terminated or dropped below a pre-selected signal strength.

Preferably, the coded signal is a pulsed signal which is transmitted periodically. The extraneous signal may be another coded signal and preferably the monotoring means is adapted to monitor an extraneous signal which is another coded signal. However the extraneous signal may be a non-coded signal.

In a preferred embodiment the receiver is adapted to be operatively associated with a vehicle so that the warning signal is perceivable to the operator of the vehicle.

The warning signal generated by the receiver in response to reception and recognition of the coded signal may be audible and/or visual. Where the warning signal is audible it may be integrated with the vehicle's radio or other sound reproduction equipment. The receiver may be connected to the vehicle's electrical system so that it is operable at all times the vehicle is in use.

The transmitter may be operatively associated with a hazard such as road works, ice or rail crossings. Different types of hazards may have unique coded signals allowing the receiver to discriminate between different types of hazards. In this case, the warning signal may identify the particular type of hazard for the operator of the vehicle.

It is preferred that the first transmitter is operatively associated with an emergency vehicle. In this case, the actuation of the transmitter may be coupled with the actuation of conventional lights and/or sirens. Again, different types of emergency vehicles may have unique coded signals allowing the receiver to discriminate between different types of emergency vehicles.

It is preferred that the transmitter has an effective range of not less than 100 meters and not more than 1000 meters, more preferably not less than 200 meters and not more than 500 meters.

Of course, the system may operate with both emergency vehicles and fixed hazards, in which case it is particularly desirable that the receiver be able to discriminate between coded signals originating from different sources.

BRIEF DESCRIPTION OF THE DRAWINGS

In order that this invention may be more easily understood and put into practical effect, reference will now be made to the accompanying drawings which illustrate a preferred embodiment of the invention, wherein.

DETAILED DESCRIPTION OF A PREFERRED EMBODIMENT

The present applicant's Australian Patent Application 76391/87 provides a full description of the basic principles of the warning system.

The warning system is based on a radio transmitter and receiver combination with controlled power output and receiver sensitivity to maintain a workable range of about 300 meters.

Figure 1:
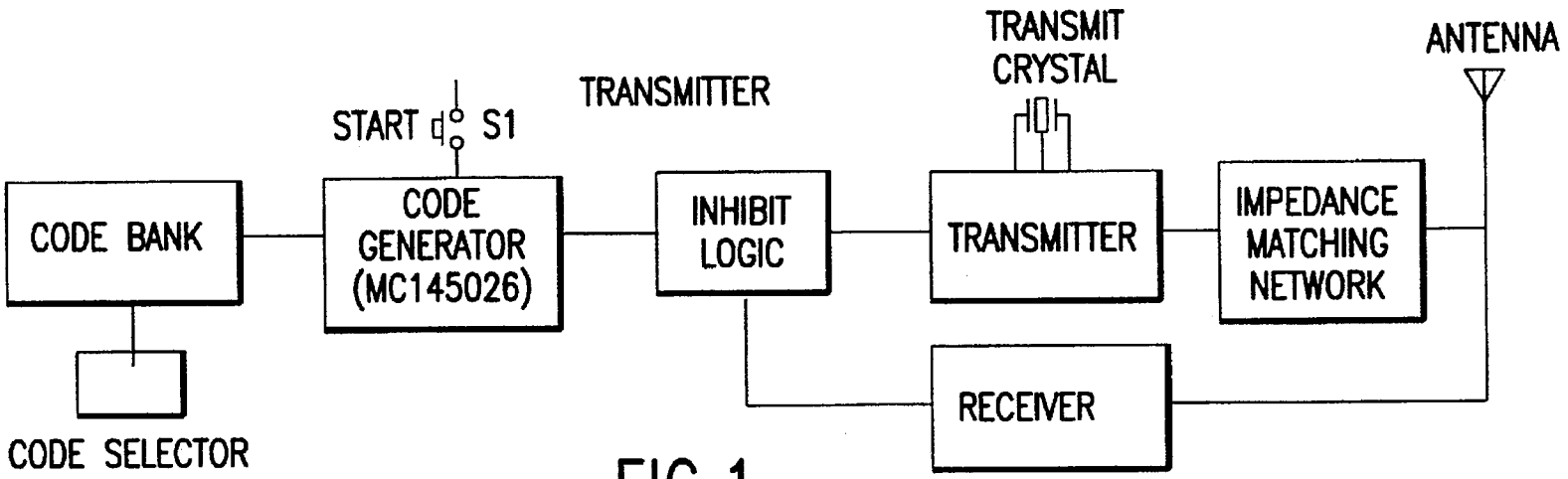
FIG. 1 is a block diagram of the transmitter.
Figure 2:
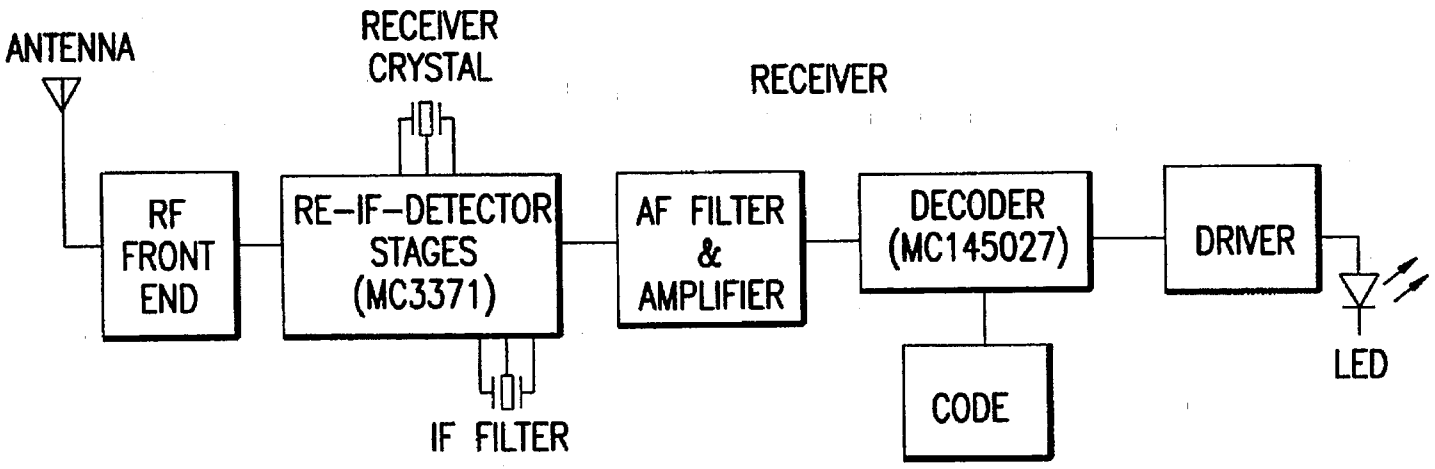
FIG. 2 is a block diagram of the receiver.
Figure 3A:
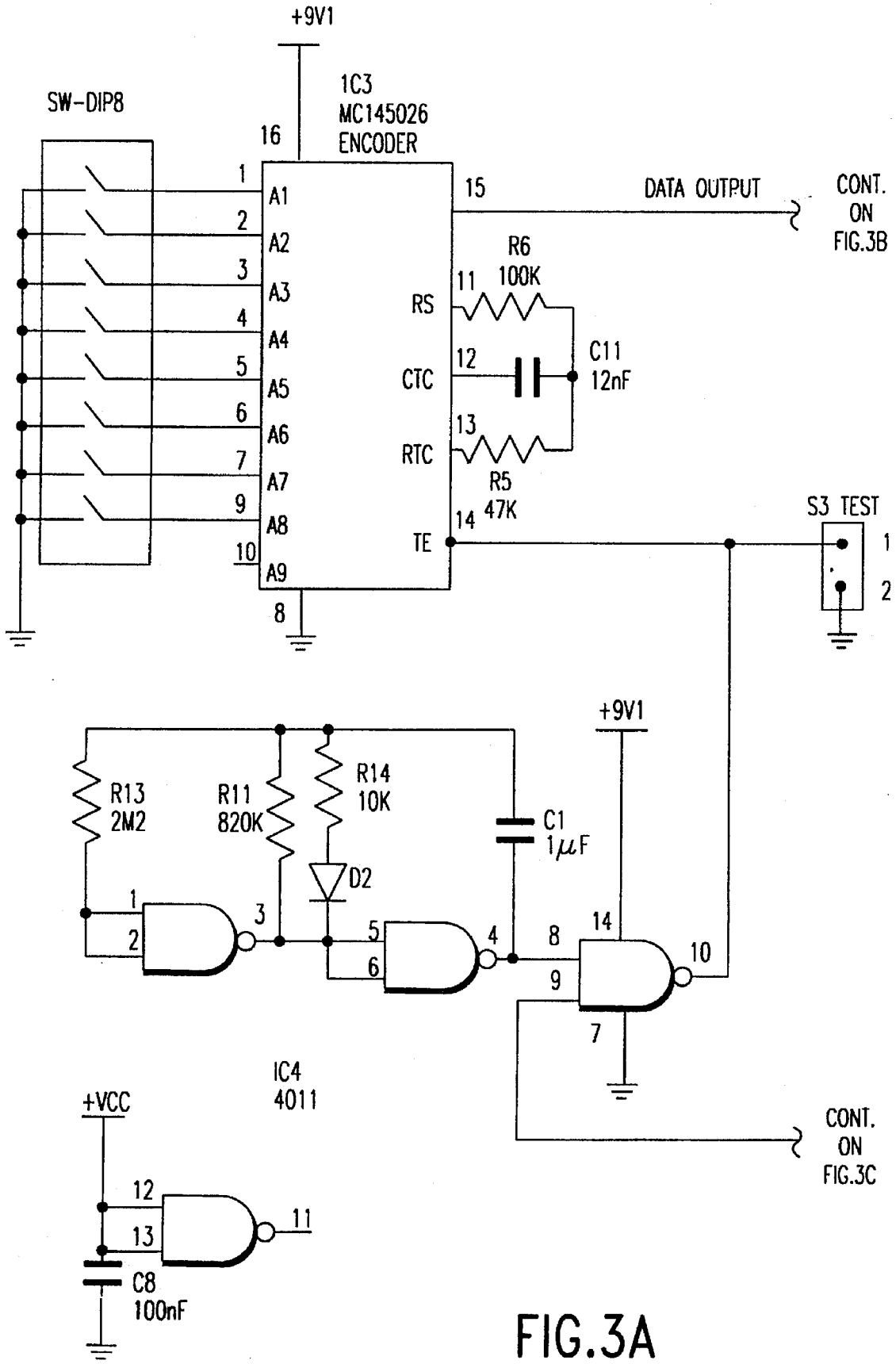
FIG. 3 is a circuit diagram of the transmitter.
Figure 3B:
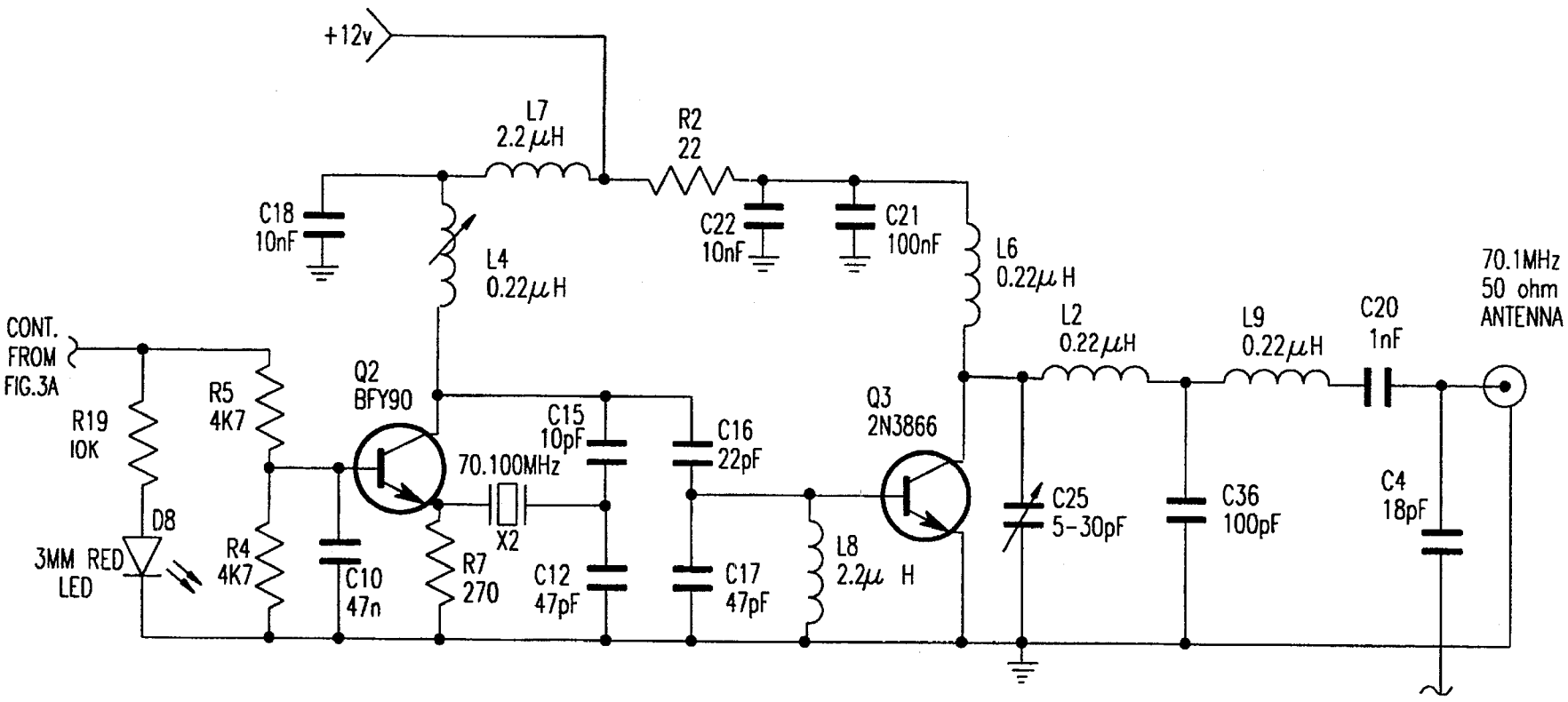
Figure 3C:
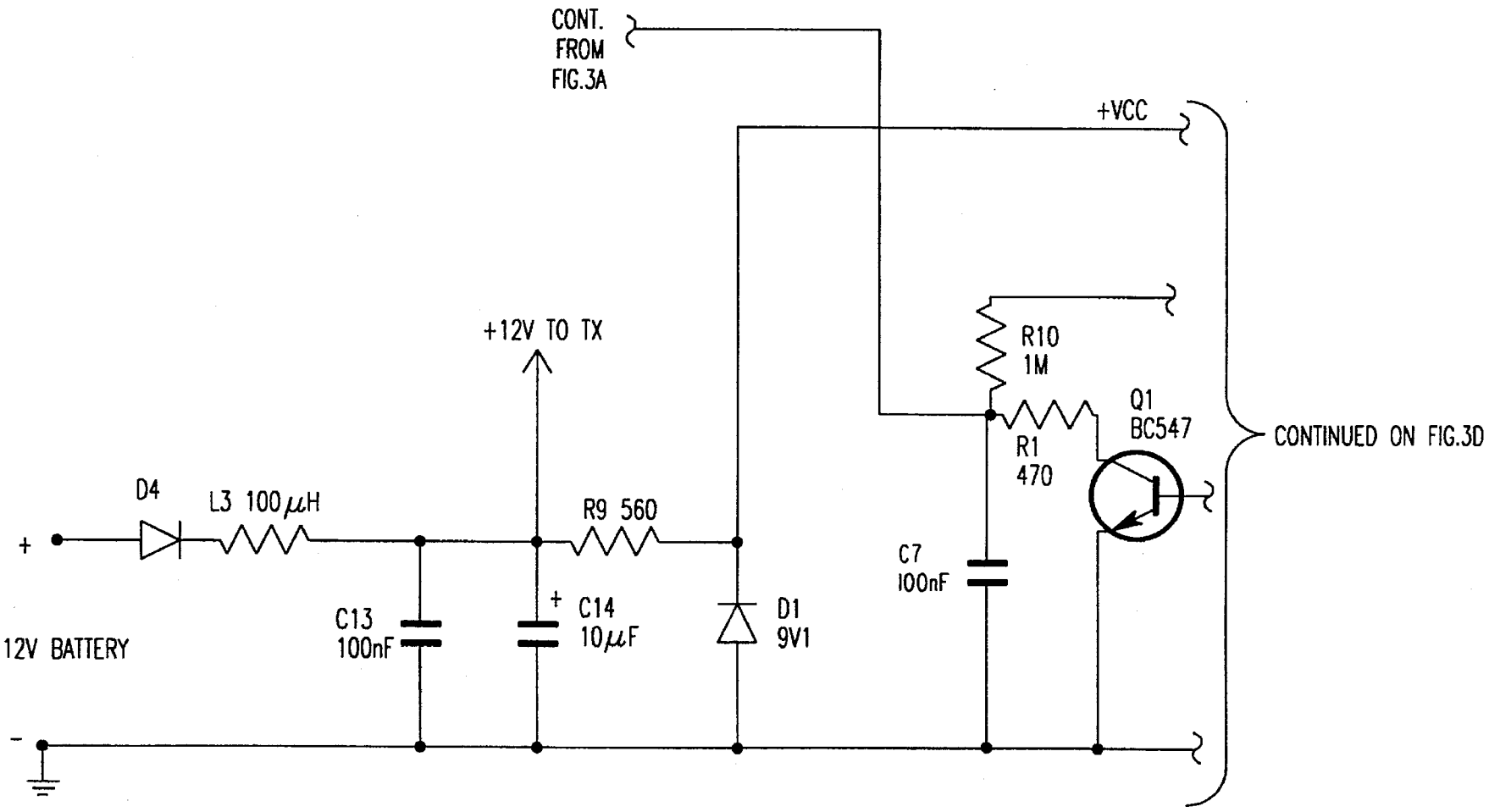
Figure 3D:
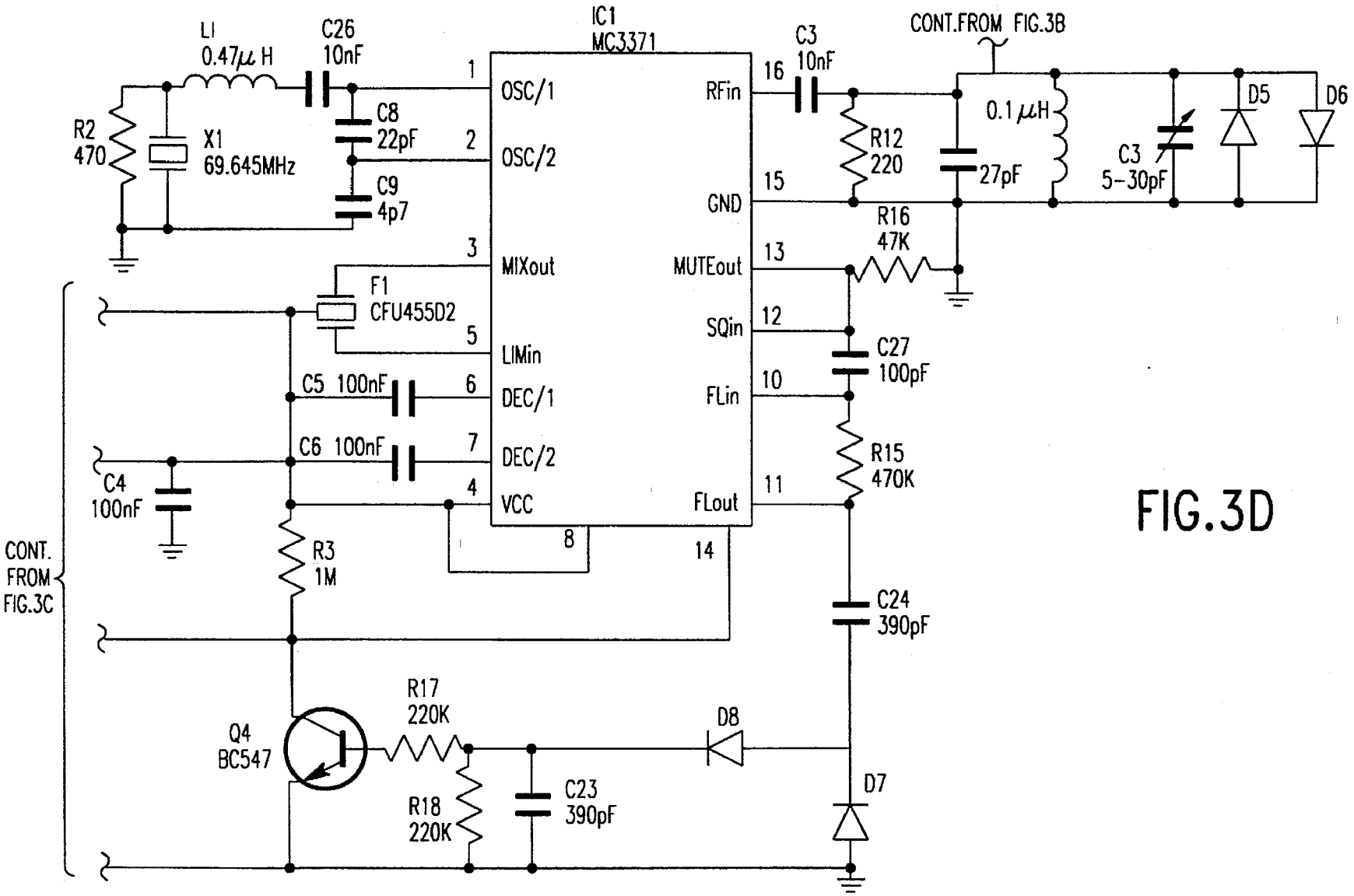
Figure 4A:
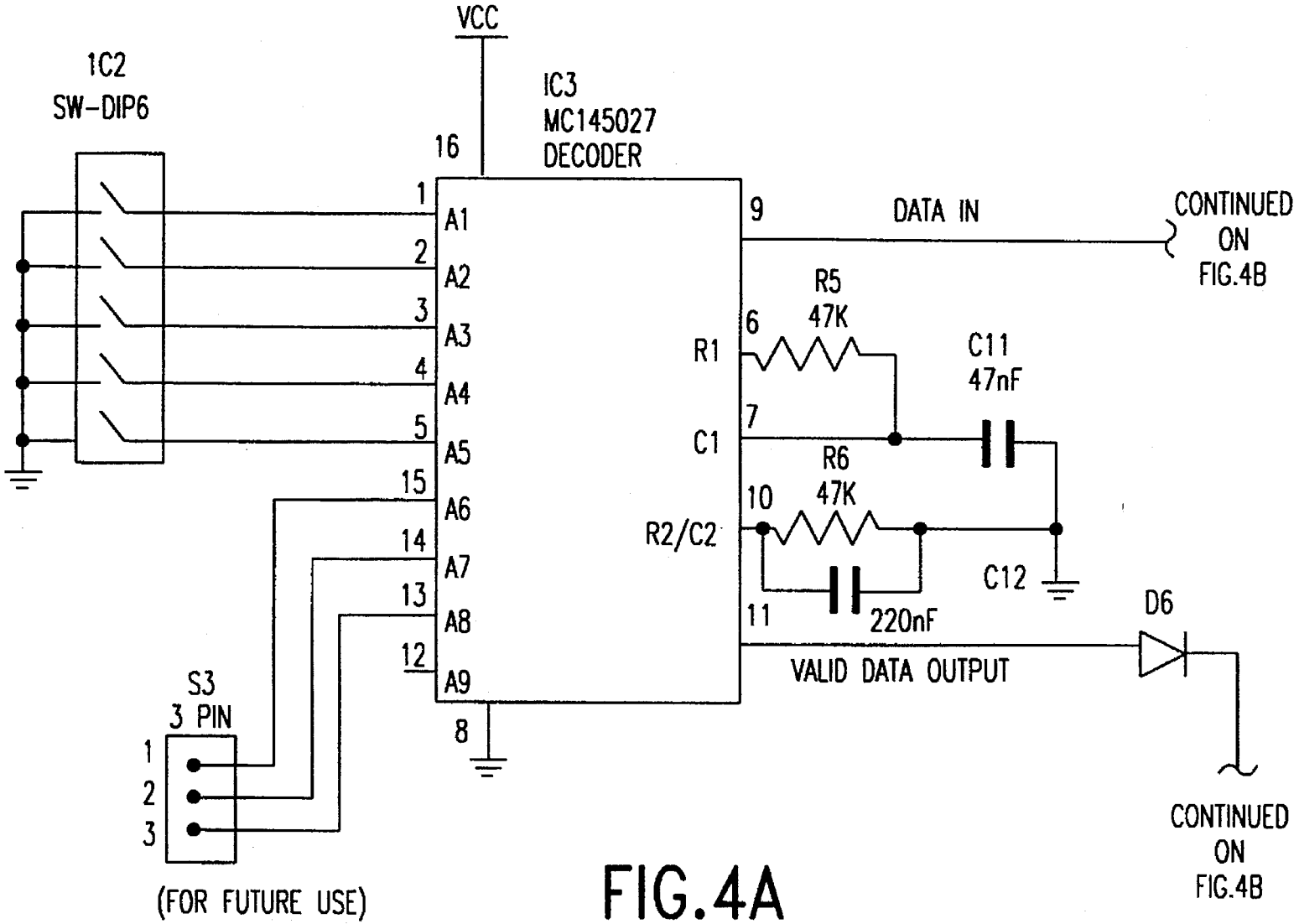
FIG. 4 is a circuit diagram of the receiver.
Figure 4B:
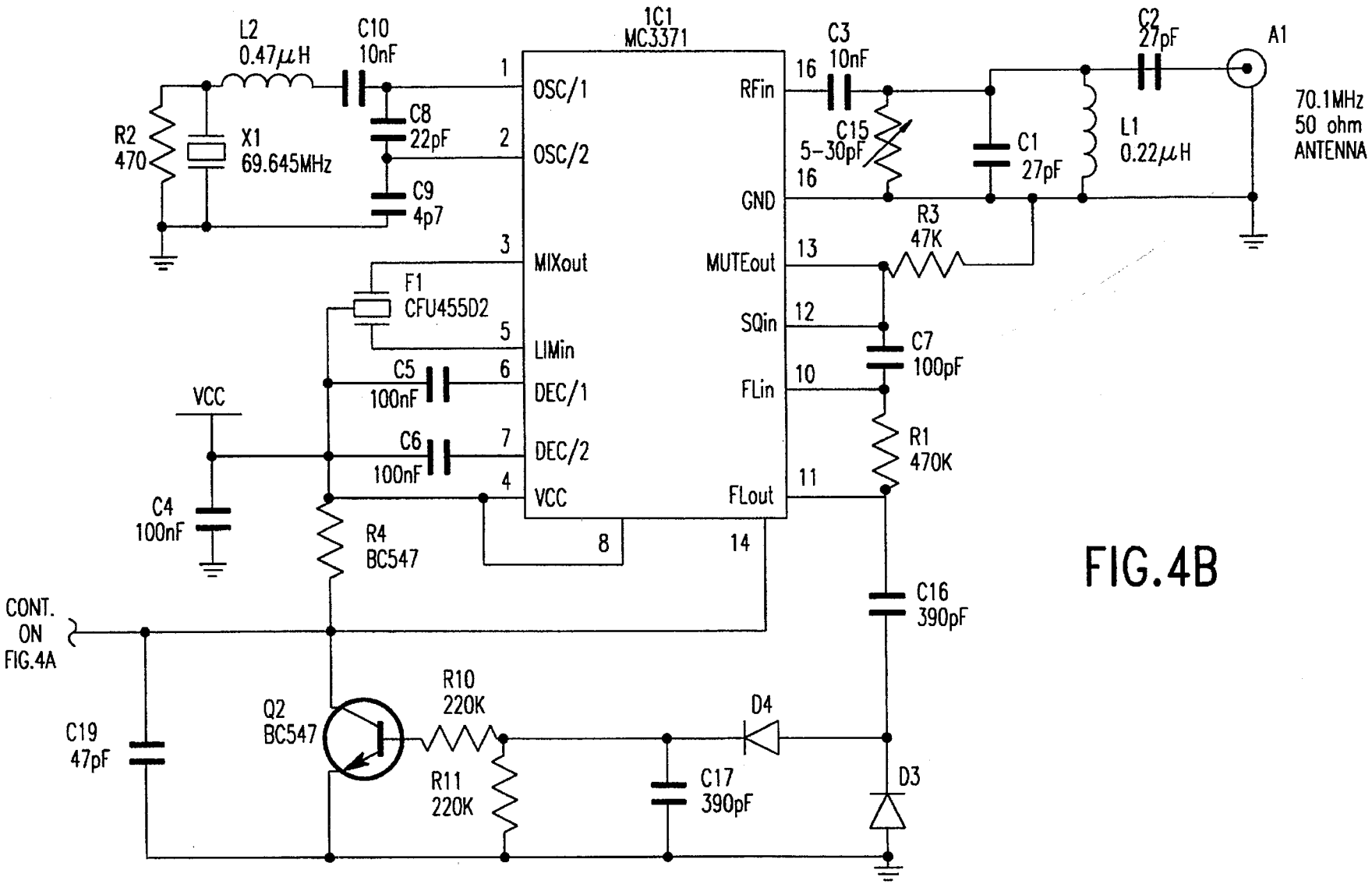
Figure 4C:
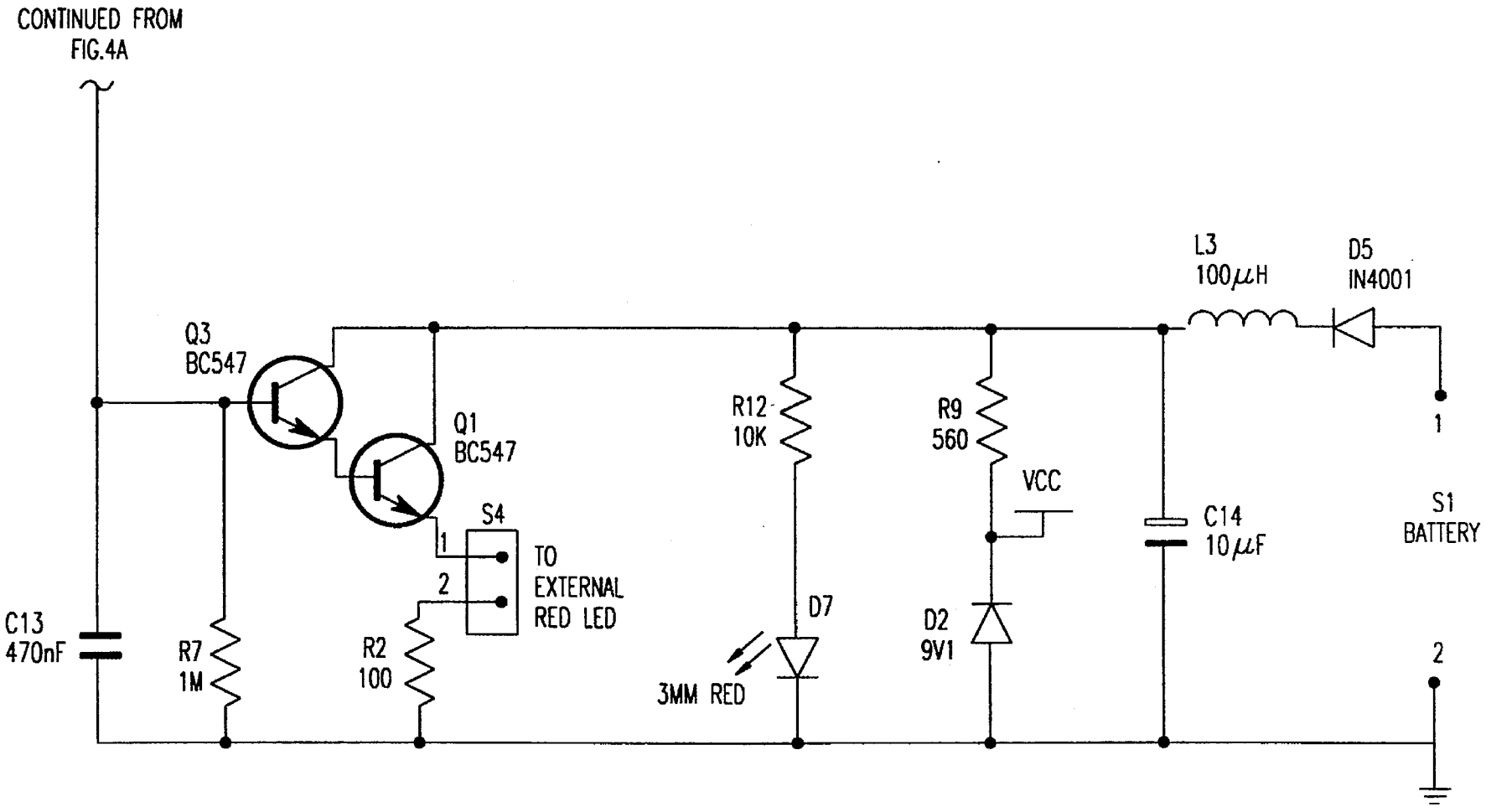

As shown in FIGS. 1 and 2, the transmitter sends out pulses of radio frequency energy at approximately one (1) second intervals. The one (1) second period has a broad tolerance which has the effect of randomizing the timing of pulses from different transmitters. The pulses are encoded with an eight (8) bit data signal. The receiver will generate an alert once a valid coded signal is decoded. In the case where the receiver does not decode a valid signal, no alert is generated. This feature protects the system against false alerts which could be caused by interference signals or bursts of noise from electrical equipment or even deliberate jamming.

Protection of the integrity of the transmitted signal is accomplished by monitoring the relevant frequency for the presence of other signals, such as other coded signals originating from other emergency vehicles.

Protection of the coded pulses of radio signal is incorporated to prevent corruption of the data that can occur when two or more signals interfere with each other. In the absence of other signals, the transmitter will emit a signal immediately upon being activated. When the presence of an extraneous signal is detected the transmitter will introduce a delay before transmitting thereby preventing superimposition of the signals and corruption of the coded signal.

The radio transmitter has been designed to provide a fixed level output signal which is fed into an electrically short antenna. The combination of these two features is such as to ensure the permitted emission levels are within the FCC/SMA government levels for unlicenced transmitter operation.

The 70 Mhz band is available in both Australia and the USA for low power unlicenced transmitters. The selected frequency in Australia is 70.1 Mhz and it is envisaged that a similar frequency will be used in the USA. The maximum permitted emission level in Australia is 99 dBuV/m, and in the USA is 125 dBuV/m. In both cases the emission levels are constrained to the 99 dBuV/m level to achieve constant ranging of the system.

Minor frequency alterations should be all that is necessary to meet the requirements of other government administrations that control the use of the radio spectrum.

The system is designed to operate from a DC power source with negative earth with a voltage range of 12 to 24 volts. This allows flexible installation in conventional vehicles. The transmitter will operate from 12 volts DC negative earth and is intended to mount in or around the warning light assembly of emergency vehicles. The system is designed to operate from −10 C to +60 C with non-condensing humidity environment.

Transmitter Circuit Description

In FIG. 3, the transmitter operation is controlled by a clocking generator made up of two (2) CMOS NAND gates IC4 (4011) which generate a pulse train of approximately one (1) second duration. These pulses are fed to the code generator chip IC3 through pin 14.

The transmitter keying is controlled by a code generator IC3 (45026) and the associated code word programming performed by settings of pins 1 through 9 on IC3. The encoded data 1 through 5 set the "valid" code sequence for correct operation. The remaining data bits 6, 7 and 8 are used to identify the source or other attributes of the transmission. The LED indicator D5 connected to pin 15 of IC3 serves as a transmitted signal indicator.

Pin 15 of IC3 also activates the radio frequency (RF) oscillator. The RF oscillator comprises transistor Q2, crystal X2, and inductance L4. The oscillator operates on 70.100 Mhz, the output of which drives the final output transistor Q3. The resulting signal is amplified by Q3 and unwanted energy is filtered out by the LC filters consisting of L2, L6, L9, C2, C25, C30. The output is then fed to the transmitting antenna.

A pilot receiver consisting of IC1 (MC3371) and associated components controls the transmit timing to prevent two transmitters from operating simultaneously. The pilot receiver is also crystal locked to 70.1 Mhz. The pilot receiver uses the transmitting antenna for monitoring purposes and is disabled while the local transmitter is active. If the pilot receiver does detect another transmitter, the local transmission is delayed by inhibiting the timer signal from IC4 through the gate IC4 (c) and Q1.

The transmitter unit is protected against reverse polarity connections to the power source. Noise filtering is also incorporated using C13, C14 and L3, minimising effects of alternator, ignition noise and conducted radiation from other transmitters within the vehicle.

Receiver Circuit Description

In FIG. 2, the signal from the antenna is filtered against unwanted radiation from other sources by the components C1, C2, C15, C20 and L1. The main receiver accepts the signal on pin 16 on IC1 (MC3371). This signal is mixed with the local oscillator frequency determined by crystal X1 which operates as a low side injection superheterodyne. The resulting intermediate frequency (IF) of 455 Khz is filtered by F1. The IF signal is amplified in IC1 and FM detection is also performed in IC1. The output signal is obtained at pin 14 of IC1.

A fast squelch system to provide noise free detection is accomplished by the components C7, C16, C17, C19, R1, R10, R11, R14, D3, D4 and Q2.

The detected signal is passed to the decoder IC3 (45027) through pin 9. Data bits 1 and 5 are checked against the "valid" codeword set by jumpers connected to pins 1 through 5 of IC3. In the case where a valid codeword is detected an output is generated on pin 11 of IC3. The remaining data bits 6, 7 and 8 appear at pins 13, 14 and 15. This output is reserved for future product enhancement.

The valid signal output from pin 11 of IC3 is fed to a pulse shaper comprising D6, C13, R7 and Q3. The shaper provides a duty cycle of approximately 50% for clear viewing of the warning light. Transistor Q1 is used to drive the external light directly.

Diode D5 is used for reverse voltage protection and diode D2 provides the 9.1 volt (vcc) regulated power feed to the decoder and receiver chips.

The present invention provides a warning system wherein the coded transmission is delayed where an extraneous signal is detected. This reduces the likelihood of superimposition of the coded signal and hence corruption of the code. Accordingly, the present invention provides a more reliable and safer system with greater integrity.

It will of course be realised that whilst the above has been given by way of illustrative example of this invention, all such and other modifications and variation hereto, as would be apparent to persons skilled in the art, are deemed to fall within the broad scope and ambit of this invention as is hereinafter claimed.

I claim:

1. A warning system comprising:

a receiver to receive and recognize a coded signal, and upon reception and recognition thereof to generate a warning signal; and a transmitter selectively actuable to transmit the coded signal receivable and recognizable by the receiver and including monitoring means for monitoring the presence of an extraneous signal originating from another transmitter, said transmitter delaying transmission of the coded signal upon detection of the extraneous signal from said another transmitter;

wherein the transmission of the coded signal is delayed by a predetermined time interval or is delayed until the monitoring means determines that the extraneous signal has terminated or dropped below a pre-selected signal strength.

2. A warning system as defined in claim 1, wherein said monitoring means monitors said extraneous signal which is another coded signal.

3. A warning system as defined in claim 1, wherein said receiver is operatively associated with a vehicle so that the warning signal is perceivable to the operator of the vehicle.

4. A warning system comprising:

a receiver to receive and recognize a coded signal, and upon reception and recognition thereof to generate a warning signal; and a transmitter selectively actuable to transmit the coded signal receivable and recognizable by the receiver and including monitoring means for monitoring the presence of an interfering signal originating from another signal source, wherein said transmitter delays transmission of the coded signal when said interfering signal is present;

wherein said transmitter is enabled to begin transmitting a pre-determined time after the monitor first indicates the presence of said interfering signal, or when the strength of said interfering signal terminates or drop below a pre-determined threshold.

5. A warning system as defined in claim 4, wherein said receiver is operatively associated with a vehicle so that the warning signal is perceivable to the operator of the vehicle.

6. A warning system as defined in claim 5, wherein said transmitter is located at a hazard to said vehicle and said coded signal is coded to indicate the type of hazard at which said transmitter is located.

7. A warning system as defined in claim 4, wherein the signal strength of said transmitter is controlled and the sensitivity of said receiver is controlled so as to limit to a predetermined limit the range at which said transmitter and receiver can communicate.

* * * * *